US005297391A

United States Patent [19]

Roche

[11] Patent Number: 5,297,391

[45] Date of Patent: Mar. 29, 1994

[54] FUEL INJECTOR FOR A TURBOJET ENGINE AFTERBURNER

[75] Inventor: Jacques A. M. Roche, Lisses, France

[73] Assignee: Societe Nationale d'Etude et de Construction de Moteurs d'Aviation (S.N.E.C.M.A.), Valin, France

[21] Appl. No.: 32,484

[22] Filed: Mar. 17, 1993

[30] Foreign Application Priority Data

Apr. 1, 1992 [FR] France ..... 92.03936

[51] Int. Cl.[5] ..... F02C 3/04

[52] U.S. Cl. ..... 60/740; 60/261; 60/262

[58] Field of Search ..... 60/740, 261, 262, 737, 60/738, , 749

[56] References Cited

U.S. PATENT DOCUMENTS

| | | | |
|---|---|---|---|
| 2,861,424 | 11/1958 | Jurisich | 60/749 |
| 3,698,186 | 10/1972 | Beande et al. | 60/271 |
| 3,800,530 | 4/1974 | Nash | 60/261 |
| 4,730,453 | 3/1988 | Benoist et al. | 60/261 |
| 4,887,425 | 12/1989 | Vdoviak | 60/261 |
| 4,901,527 | 2/1990 | Nash et al. | 60/749 |

*Primary Examiner*—Richard A. Bertsch
*Assistant Examiner*—Timothy S. Thorpe
*Attorney, Agent, or Firm*—Bacon & Thomas

[57] ABSTRACT

A fuel injector for a turbojet engine afterburner is disclosed having a fuel tube extending radially inwardly into an afterburner combustion chamber from the engine casing, the fuel injector tube defining a plurality of downstream facing fuel discharge orifices along a portion of its length in order to discharge fuel into the afterburner combustion chamber. A cooling device is associated with the fuel tube in order to direct cooling air from a bypass passage of the engine onto the fuel tube in order to cool the fuel tube, not only when the afterburner is in operation, but also when the afterburner is not in operation. The cooling device is an elongated tubular enclosure which substantially encloses the fuel tube, the elongated tubular enclosure having a significantly larger cross-sectional area than that of the fuel tube so as to define a cooling cavity between them. The elongated tubular enclosure, which is also attached to the turbojet engine casing, passes through the bypass passage and defines inlet openings to enable a portion of the air in the bypass passage to pass through the opening and into the cooling cavity so as to cool the fuel tube. A downstream portion of the elongated tubular enclosure defines a slit which is in alignment with the plurality of fuel discharge orifices of the fuel tube so as to enable the fuel to be injected into the afterburner combustion chamber.

6 Claims, 2 Drawing Sheets

FIG. 2
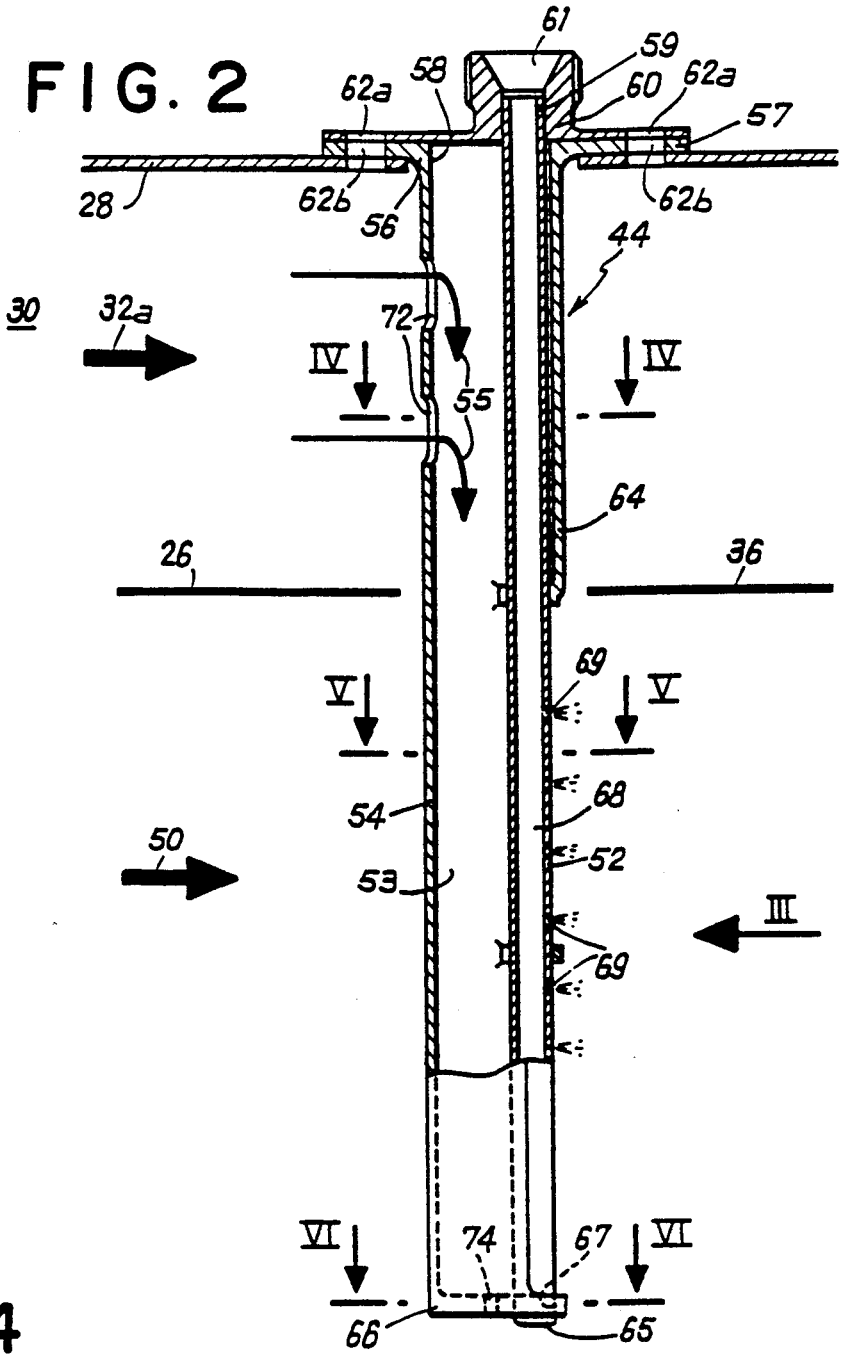
FIG. 3
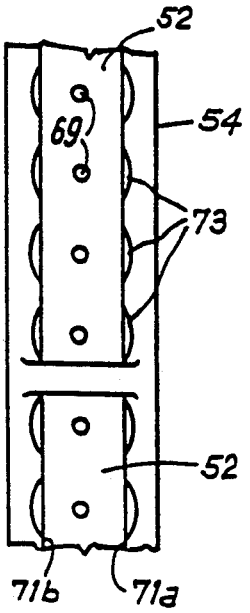
FIG. 4
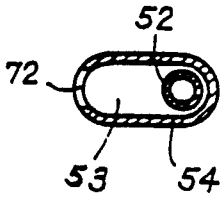
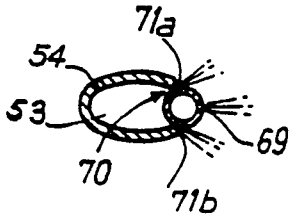
FIG. 5
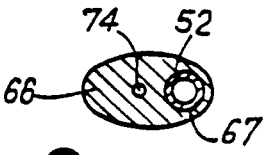
FIG. 6

FUEL INJECTOR FOR A TURBOJET ENGINE AFTERBURNER

BACKGROUND OF THE INVENTION

The present invention relates to a fuel injector for an afterburner of a turbojet engine, more particularly such a fuel injector which improves cooling of the fuel tube.

Afterburners for turbojet engines are well known in the art and have long been utilized as a means to provide additional thrust to the turbojet engine. Typically, afterburners inject fuel into the hot gases emanating from the combustion chamber of the turbojet engine, downstream of the turbine stages. The fuel may be ignited by the elevated temperature of the exhaust gases, or supplemental ignition means may be provided to ignite the fuel/gas mixture.

When the afterburner is activated, fuel passes through one or more generally radially oriented fuel injectors into the afterburner combustion chamber. The fuel passing through the injector also acts as a coolant to lower the temperature of the injector structure, which is subjected to the hot gases from the engine combustion chamber. When the afterburner is not in operation, the fuel injectors are still exposed to the high temperature exhaust gases, but do not receive the benefit of the fuel cooling, since no fuel is passing through the injectors. As a result, coking of the fuel injectors may occur and large thermal shocks may be generated when the afterburner is subsequently activated.

U.S. Pat. No. 4,887,425 discloses a fuel spray bar for an afterburner in which each fuel spray bar has a plurality of fuel tubes extending into the afterburner combustion chamber. The fuel tubes for a particular fuel spray bar each have different lengths and a cooling device is located upstream of the forwardmost fuel tube. The cooling device directs air from a bypass passage of the turbojet engine onto the fuel tubes to control their temperatures. The cooling circuits for this device comprise a number of discharge orifices located opposite the fuel tubes and means to channel the discharged cooling air around the tubes. Such structure requires delicate machining of the parts to ensure that the space between the tubes and the cooling means be uniform over their entire lengths.

SUMMARY OF THE INVENTION

A fuel injector for a turbojet engine afterburner is disclosed having a fuel tube extending radially inwardly into an afterburner combustion chamber from the engine casing, the fuel injector tube defining a plurality of downstream facing fuel discharge orifices along a portion of its length in order to discharge fuel into the afterburner combustion chamber. A cooling device is associated with the fuel tube in order to direct cooling air from a bypass passage of the engine onto the fuel tube in order to cool the fuel tube, not only when the afterburner is in operation, but also when the afterburner is not in operation. This prevents coking of the fuel injector and ensures the reliable operation of the afterburner.

The cooling device comprises an elongated tubular enclosure which substantially encloses the fuel tube, the elongated tubular enclosure having a significantly larger cross-sectional area than that of the fuel tube so as to define a cooling cavity between them. The elongated tubular enclosure, which is also attached to the turbojet engine casing, passes through the bypass passage and defines inlet openings to enable a portion of the air in the bypass passage to pass through the opening and into the cooling cavity so as to cool the fuel tube. A downstream portion of the elongated tubular enclosure defines a slit which is in alignment with the plurality of fuel discharge orifices of the fuel tube so as to enable the fuel to be injected into the afterburner combustion chamber. An end wall of the elongated tubular enclosure defines an opening through which the end of the fuel tube passes so as to facilitate relative movement between the fuel tube and the elongated tubular enclosure caused by thermal expansion and contraction of these elements.

Opposite sides of the elongated tubular enclosure which define the slit, also define a plurality of air discharge orifices to enable the cooling air to exit from the cooling chamber. The end wall of the elongated tubular enclosure may also define an air discharge opening.

Both the fuel tube and the elongated tubular enclosure may be removably attached to the engine casing by standard fastening devices to enable them to be readily removed from the engine structure. Also, since only one end of each of the fuel tube and the elongated tubular enclosure is attached, relative thermal expansion may take place without inducing undue stresses to either of these elements. Although the radially inner, or distal end of the fuel tube is allowed to longitudinally move with respect to the elongated tubular enclosure, the opening in the end wall through which the end of the fuel tube passes also ensures that this end of the fuel tube will be accurately located within the afterburner combustion chamber.

BRIEF DESCRIPTION OF THE DRAWINGS

FIG. 2 is a cross-sectional, side elevational view of the fuel injector structure according to the present invention.

FIG. 3 is a partial, rear view of the fuel injector according to the present invention viewed in the direction of arrow III in FIG. 2.

FIG. 4 is a cross-sectional view taken along line IV—IV in FIG. 2.

FIG. 5 is a cross-sectional view taken along line V—V in FIG. 2.

FIG. 6 is a cross-sectional view taken along line VI—VI in FIG. 2.

DETAILED DESCRIPTION OF THE PREFERRED EMBODIMENT

Figure 1:
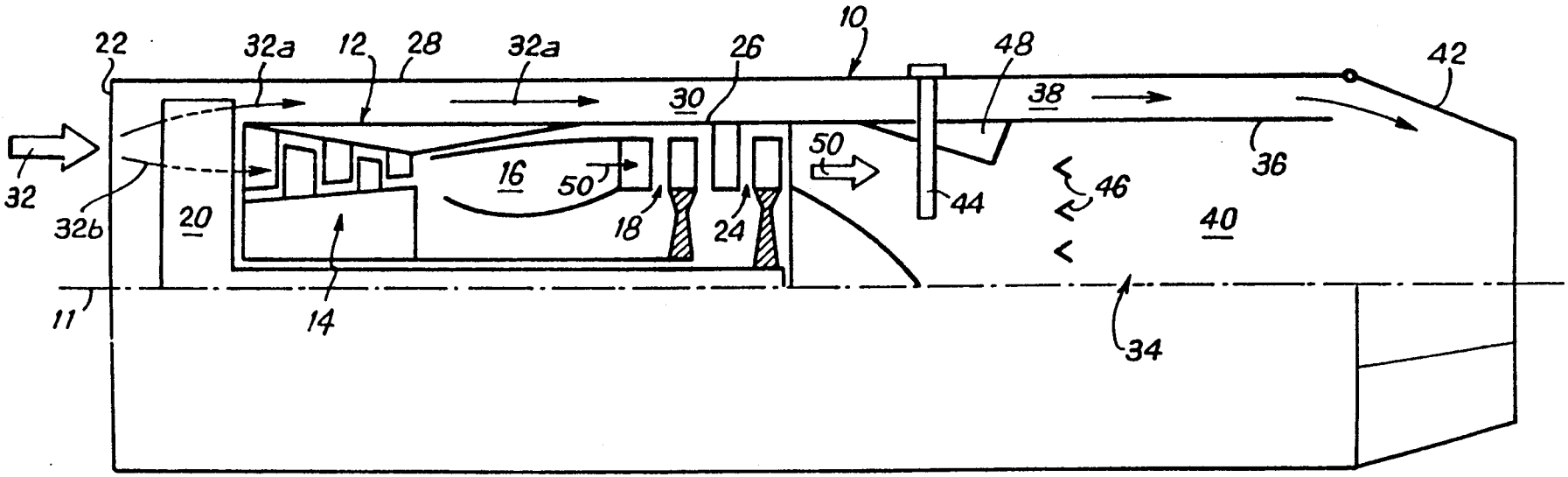
FIG. 1 is a schematic side view of a gas turbine engine, partially in cross section, illustrating a turbojet engine with an afterburner combustion chamber equipped with fuel injectors of the present invention.

FIG. 1 illustrates schematically a gas turbine engine 10 having a longitudinal, central axis 11 and which comprises a conventional gas generator 12 consisting of a compressor 14, a combustion chamber 16, a high pressure turbine 18 and a low pressure turbine 24. The high pressure turbine 18, in known fashion, is operatively connected to and drives the compressor 14. The gas turbine engine furthermore comprises a fan 20 located upstream (towards the left as viewed in FIG. 1) of the compressor 14 and an ambient air intake 22. Fan 20 is linked to and driven by the low pressure turbine 24, in known fashion. The gas generator 12 is mounted inside an inner annular case 26 which, in turn, is mounted inside an external case 28 such that the inner case 26 and the external case 28 define between them a bypass passage 30. The bypass passage 30 receives a portion 32*a* of the air 32 passing through the intake 22, such portion generally designated as secondary air. The remainder of the air, illustrated at 32*b*, is channeled so as to enter the compressor 14. An afterburner combustion chamber 34 is located downstream (towards the right as viewed in FIG. 1) of the gas generator 12 and comprises an annular cooling lining 36 located inside the external case 28 of the gas turbine engine and bounding, with the case 28, an annular cooling air passage 38. Lining 36 also bounds an afterburner combustion zone 40. A conventional exhaust nozzle 42 is located at the downstream end of the external case 28.

A number of radially extending, circumferentially spaced fuel injectors 44 extend into the afterburner combustion chamber 34 to supply fuel to the gases emanating from the gas generator 12. The fuel injectors 44 are attached to the external case 28 and pass through the cooling lining 36 such that they may be connected to a source of fuel (not shown). The fuel injectors 44 supply fuel to the afterburner combustion chamber 34 upstream of a plurality of flame holders 46. A conventional lobed mixer 48 is located between the gas generator 12 and the afterburner combustion chamber 34 to facilitate mixing of the fuel, air and the gases 50 emanating from the gas generator 12.

During operation, air 32 enters the air intake 22 such that a portion 32*a* passes into bypass passage 30, thereby bypassing the gas generator 12, while a second portion of air 32*b* enters the compressor 14. Air entering the compressor 14 is compressed prior to entering the combustion chamber 16 wherein it is mixed with fuel and burned. The combustion gases 50 produced in the combustion chamber 16, which are hot and at high pressure, pass through the high pressure turbine 18, which drives the compressor 14, and through the low pressure turbine 24, which drives the fan 20. The gases 50 emanating from the gas generator 12 are channeled opposite the injectors 44 and are mixed with a portion of the bypass air 32*a* by the lobed mixer 48 in the afterburner combustion chamber 34.

When it is desired to increase the thrust of the turbojet engine 10, fuel is discharged into the afterburner combustion chamber 34 through the fuel injectors 44, mixed with the gases 50 as well as a portion of the bypass air 32*a* and is burned downstream of the flameholders 46 in the combustion zone 40. The portion of the air 32*a* which is not tapped by the lobed mixer 48, passes into the annular passage 38 to ensure cooling of the lining 36 and is discharged at the downstream end of the lining 36 along the inside surface of the exhaust nozzle 42.

The fuel injector structure according to the present invention is illustrated in detail in FIGS. 2–6. The fuel injector 44 comprises a fuel tube 52 located within an elongated tubular enclosure 54 such that a cooling cavity 53 is defined between these elements. As can be seen, the cross-sectional area of the elongated tubular enclosure 54 is significantly greater than that of the fuel tube 52 so as to form the cooling cavity 53. The tubular enclosure 54 shields the fuel tube 52 from the high temperatures of the combustion gases 50 issuing from the gas generator 12 and cools the tube 52 by directing a portion of air 32*a* from the bypass passage 30, illustrated at 55, into the cooling chamber 53.

A fastening collar 57 is mounted at a first proximal end 56 of the tubular enclosure 54 and is attached to the outer case 28 by conventional fastening means (not shown), such as bolts. This proximal end 56 defines an aperture 58 to facilitate the insertion of the fuel tube 52 within the elongated tubular enclosure 54 into the cooling cavity 53. The proximal end 59 of the fuel tube 52 is attached to a base 60 which comprises a coupling 61 to receive fuel from the fuel source (not shown). The base 60 is, in turn, affixed to the fastening collar 57 of the elongated tubular enclosure 54 so as to seal the aperture 58. Preferably, the base 60 and the collar 57 define aligned bores 62*a* and 62*b* which enable them to be simultaneously attached to the external case 28 using common attaching means.

As can be seen, the cross-sectional area of the elongated tubular enclosure 54 is significantly larger than that of the fuel tube 52 so as to provide a cooling cavity 53 for the circulation of the cooling air 55.

The fuel tube 52 is located adjacent to a downstream wall 64 of the tubular enclosure 54 measured in the direction of the flow of the combustion gases 50 (from left to right as viewed in FIG. 2). The fuel tube 52 is slightly longer than the tubular enclosure 54 such that a distal end 65 of the fuel tube 52 passes through an opening 67 defined by the end wall 66 of the tubular enclosure 54 to permit the fuel tube 52 to freely expand and contract in the longitudinal direction relative to the tubular enclosure 54.

The fuel tube 52 defines a fuel passage 68 which communicates with the coupling 61 of the base 60 and which also communicates with a plurality of fuel discharge orifices 69 defined by the fuel tube 52 and which face in a downstream direction. The fuel discharge orifices 69 are located along a generatrix of the tube 52 and are all located inside the cooling lining 36 which bounds the afterburner chamber. To enable the fuel to be injected into the afterburner combustion chamber, the elongated tubular body 54 has a slit 70, which is defined by opposite edges 71*a* and 71*b*, adjacent to the fuel tube 52 and aligned with the plurality of fuel discharge orifices 69, as illustrated by FIGS. 3 and 5. The opposite edges 71*a* and 71*b* of the slit 70 also define a plurality of cooling air outlets 73 which enable the cooling air to pass from the cooling cavity 53. The cooling air 55 enters the cooling cavity 53 through cooling air inlets 72 defined by the tubular enclosure 54 adjacent to the proximal end 56 such that the cooling air inlets 72 are located within the bypass passage 30. The cooling air inlets 72 are defined by the wall of the tubular enclosure 54 near the proximal end 56 such that they face generally in an upstream direction, opposite from the air discharge orifices 73, which generally face in a downstream direction.

A complementary discharge orifice 74 is defined by the end wall 66 of the tubular enclosure 54. The discharge orifice 74, which is located upstream of the distal end 65 of the fuel tube 52 allows a jet of cooling air to be directed onto the distal end 65.

As can be seen, cooling air 55 used in the cooling of the fuel tube 52 is drawn from the relatively cold secondary air 32*a* through air inlets 72. A portion of the cooling air 55 circulates in the cooling cavity 53 and is expelled through the discharge orifice 74 due to the pressure differential between the pressures of the secondary air 32*a* and the combustion gases 50. The remaining portion of the cooling air 55 is evacuated tangentially to the fuel tube 52 through the discharge orifices 73 so as to create a protecting film downstream of the fuel tube 52.

The foregoing description is provided for illustrative purposes only and should not be construed as in any way limiting this invention, the scope of which is defined solely by the appended claims.

I claim:

1. A fuel injector for an afterburner of a turbojet engine having a case defining an afterburner combustion chamber through which gases pass in an upstream to downstream direction, comprising:

a) a fuel tube extending into the afterburner combustion chamber, the fuel tube defining a plurality of fuel discharge orifices along a portion of its length, the plurality of fuel discharge orifices facing generally in a downstream direction;

b) an elongated tubular enclosure substantially enclosing the fuel tube, the elongated tubular enclosure having a larger cross-sectional area than that of the fuel tube so as to define a cooling cavity therebetween, and defining a slit aligned with the plurality of fuel discharge orifices such that fuel from the discharge orifices passes into the afterburner combustion chamber through the slit and further defining a plurality of air discharging orifices;

c) attachment means to attach proximal ends of the fuel tube and the elongated tubular enclosure to the case, wherein the attachment means comprises:

i) a fastening collar on the elongated tubular enclosure;

ii) a base attached to the fuel tube; and iii) means to removably attach the fastening collar and the base to the case;

d) an end wall extending across a distal end of the elongated tubular enclosure, the end wall defining an opening therethrough, the length of the fuel tube being greater than that of the tubular enclosure such that a distal end of the fuel tube extends through the opening so as to permit relative movement between the fuel tube and the elongated tubular enclosure caused by thermal expansion and contraction; and, e) means to supply cooling air to the cooling cavity.

2. The fuel injector of claim 1 wherein the turbojet engine has an air bypass passage and wherein the means to supply cooling air to the cooling cavity comprises at least one air inlet opening defined by the elongated tubular enclosure and communicating with the air bypass passage.

3. The fuel injector of claim 2 wherein the at least one air inlet opening faces in a direction opposite from the slit.

4. The fuel injector of claim 2 wherein the at least one air inlet opening is located adjacent to the attachment means.

5. The fuel injector of claim 1 wherein the plurality of air discharge orifices are defined by portions of the elongated tubular enclosure defining opposite sides of the slit.

6. The fuel injector of claim 1 further comprising a second opening defined by the end wall of the elongated tubular enclosure to allow air in the elongated tubular enclosure to discharge therethrough.

* * * * *